US011061349B2

(12) United States Patent
Imamiya et al.

(10) Patent No.: US 11,061,349 B2
(45) Date of Patent: Jul. 13, 2021

(54) HEATING DEVICE, FIXING DEVICE AND IMAGE FORMING APPARATUS

(71) Applicant: TOSHIBA TEC KABUSHIKI KAISHA, Tokyo (JP)

(72) Inventors: Koji Imamiya, Kawasaki Kanagawa (JP); Chie Miyauchi, Odawara Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/835,117

(22) Filed: Mar. 30, 2020

(65) Prior Publication Data

US 2020/0225607 A1 Jul. 16, 2020

Related U.S. Application Data

(63) Continuation of application No. 16/215,344, filed on Dec. 10, 2018, now abandoned.

(30) Foreign Application Priority Data

Feb. 13, 2018 (JP) ..... JP2018-023154

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 15/2042* (2013.01)

(58) Field of Classification Search
CPC ..... G03G 15/2053; G03G 15/2042; G03G 15/2039; G03G 2215/2035
USPC ..... 399/333
See application file for complete search history.

(56) References Cited

U.S. PATENT DOCUMENTS 5,596,397 A * 1/1997 Shimada ..... F28D 15/02 219/469
2005/0258158 A1 11/2005 Takami et al.
2007/0242990 A1* 10/2007 Ohhara ..... G03G 15/553 399/329
2012/0121304 A1 5/2012 Tokuda et al.
2013/0183072 A1* 7/2013 Hase ..... G03G 15/2053 399/329
2015/0139708 A1 5/2015 Shimura et al.
(Continued)

FOREIGN PATENT DOCUMENTS

JP H06-19345 A 1/1994
JP H08-137305 A 5/1996
(Continued)

OTHER PUBLICATIONS

Extended European Search Report dated Jul. 16, 2019 in corresponding European Patent Application No. 19155444.3, 8 pages.

*Primary Examiner* — Walter L Lindsay, Jr.
*Assistant Examiner* — Jessica L Eley
(74) *Attorney, Agent, or Firm* — Kim & Stewart LLP

(57) ABSTRACT

In one embodiment, a heating device to be used in a fixing device to fix a toner image to a medium has a heat pipe, a heater, and a heat conductive layer. The heater has a heating portion, and heats the medium via the heat pipe. The heat conductive layer is provided between the heating portion and the heat pipe, and conducts heat from the heating portion to the heat pipe.

19 Claims, 12 Drawing Sheets

(56) References Cited

U.S. PATENT DOCUMENTS

| | | | | |
|---|---|---|---|---|
| 2015/0168895 | A1* | 6/2015 | Nishizawa | G03G 15/2053 399/330 |
| 2016/0116871 | A1 | 4/2016 | Kikuchi et al. | |
| 2016/0132006 | A1* | 5/2016 | Narahara | G03G 15/2053 399/329 |
| 2016/0274511 | A1* | 9/2016 | Ogino | G03G 15/2064 |
| 2017/0090371 | A1* | 3/2017 | Sone | G03G 15/2042 |
| 2018/0284659 | A1* | 10/2018 | Miura | B05D 1/30 |

FOREIGN PATENT DOCUMENTS

| | | | |
|---|---|---|---|
| JP | 2004-235001 | A | 8/2004 |
| JP | 2013-142834 | A | 7/2013 |

* cited by examiner

HEATING DEVICE, FIXING DEVICE AND IMAGE FORMING APPARATUS

CROSS-REFERENCE TO RELATED APPLICATION

This application is a continuation of U.S. patent application Ser. No. 16/215,344, filed Dec. 10, 2018, which is based upon and claims the benefit of priority from the prior Japanese Patent Application No. 2018-023154, filed on Feb. 13, 2018, the entire contents of which are incorporated herein by reference.

FIELD

Embodiments described herein relate generally to a heating device, a fixing device using the heating device and an image forming apparatus with the fixing device.

BACKGROUND

An image forming apparatus such as multi-function peripherals has a fixing device to fix a toner image to a sheet. Recently, in the fixing device of the image forming apparatus, a ceramic heater is used as a heat source, in place of a halogen heater or the like. The ceramic heater is used as the heat source, and thereby it becomes unnecessary to perform preheating of the fixing device. For the reason, it becomes possible to reduce a power consumed in the fixing device.

However, the ceramic heater has a good responsiveness to an inputted power, and a heating amount sensitively changes in response to change in an applied voltage. For the reason, in the fixing device to use the ceramic heater as the heat source, a temperature control device to maintain the temperature of the ceramic heater to a desired temperature is essential.

In addition, in the fixing device of this kind, a sheet is heated via a heating belt or the like. For the reason, when printings are performed to a plurality of sheets in the image forming apparatus, temperature unevenness is generated in the heating belt. In the heating belt in which temperature unevenness has been generated, a temperature of an area in contact with a sheet becomes low, and a temperature of an area not in contact with the sheet becomes high. For the reason, when printing is performed to a sheet with a large width after printing has been performed to a sheet with a small width, heating unevenness is generated in the sheet, and thereby the sheet may be deformed or stain may be generated on the printing surface. Accordingly, a technology is proposed to suppress temperature unevenness in a sheet when printings are performed to sheets with different sizes.

In the conventional apparatus in which the above-described technology is adopted, temperature unevenness of the heating belt is eliminated, and accordingly it is possible to precisely form an image on a sheet. However, in the conventional apparatus, a heater longer than a width of a sheet to be heated is required. For the reason, an area of the heating belt not in contact with a sheet might be directly heated by the heater, and as a result, it is thought that power consumption used for heating a sheet might be increased.

DETAILED DESCRIPTION

Figure 1:
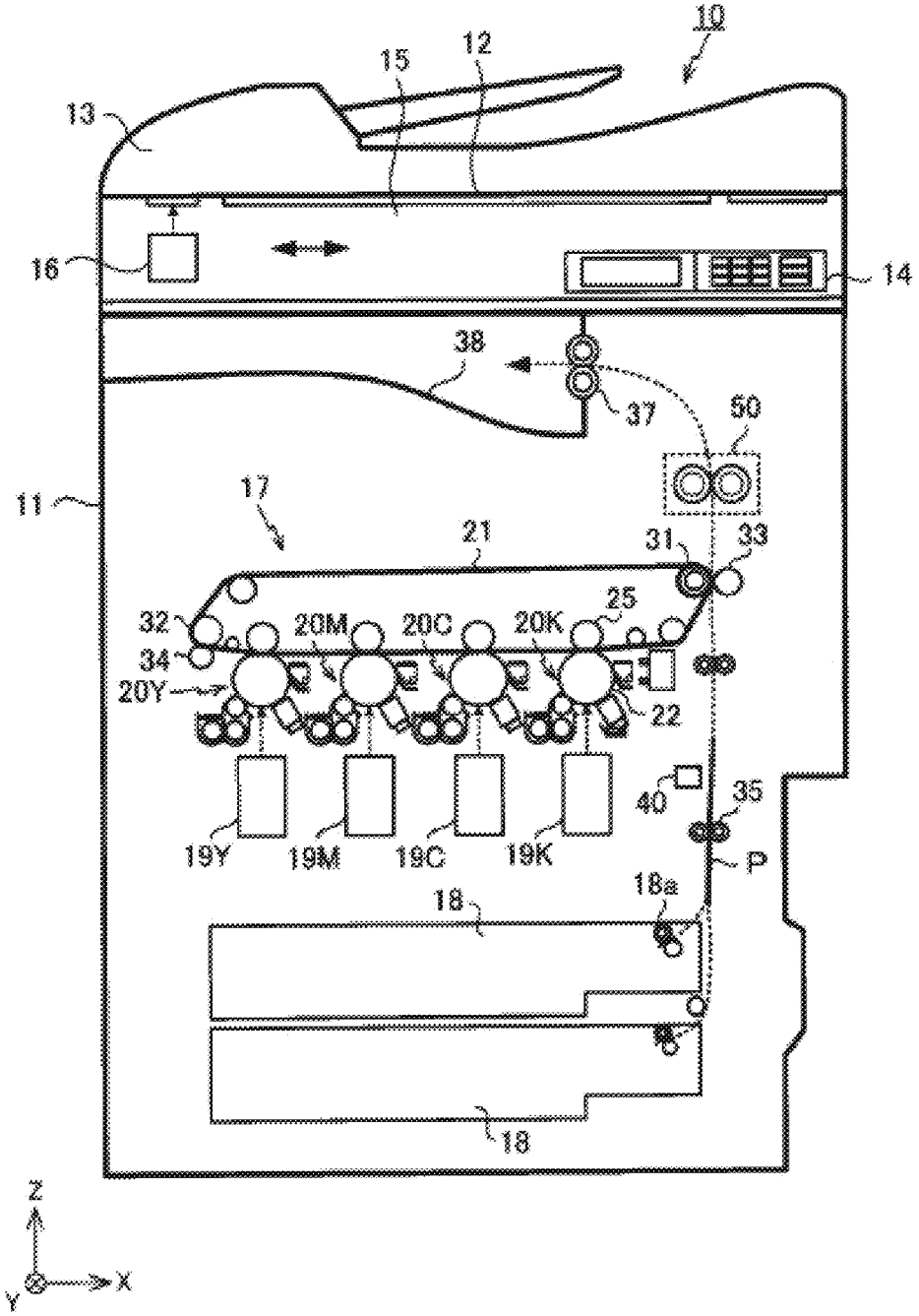
FIG. 1 is a diagram showing a configuration of an image forming apparatus according to an embodiment.

According to one embodiment, a heating device is used in a fixing device to fix a toner image to a medium. The heating device has a heat pipe, a heater, and a heat conductive layer. The heat pipe has a first surface opposite to the medium of an object to be heated. The heater has a heating portion opposite to a second surface of the heat pipe that is a surface at an opposite side of the first surface. The heat conductive layer is provided between the heating portion and the second surface of the heat pipe, and conducts heat from the heating portion to the heat pipe.

Hereinafter, an image forming apparatus according to the present embodiment will be described with reference to the drawings. In the description, an XYZ coordinate system composed of an X-axis, a Y-axis, and a Z-axis which are orthogonal to each other is used accordingly. In the drawings, the same symbols indicate the same or the similar portions.

FIG. 1 is a diagram showing a configuration of an image forming apparatus 10 according to the present embodiment. The image forming apparatus 10 is an MFP (Multi-Function Peripherals), for example. The image forming apparatus 10 has a main body portion 11 and an ADF (Auto Document Feeder) 13 to be arranged above the main body portion 11. A document table 12 composed of transparent glass is arranged above the main body portion 11. The auto document feeder (ADF) 13 is rotatably arranged at the upper surface side of the document table 12. In addition, an operation device 14 is provided above the main body portion 11. The operation device 14 has various keys, a GUI (Graphical User Interface), and so on.

A scanner 15 to read a document is provided below the document table 12. The scanner 15 reads a document to be sent by the auto document feeder 13, or a document placed on the document table 12 to generate image data. The scanner 15 has an image sensor 16.

When reading an image of the document placed on the document table 12, the image sensor 16 reads the image of the document while moving in the +X direction along the document table 12. In addition, when reading an image of the document to be fed to the document table 12 by the auto document feeder 13, the image sensor 16 is fixed to a position shown in FIG. 1, and reads images of documents to be sequentially sent for each document.

An image forming device 17 is arranged inside the main body portion 11. The image forming device 17 forms an image on a recording medium such as a sheet to be housed in a sheet feeding cassette 18, based on image data read by the scanner 15, and image data created by a personal computer or the like.

The image forming device 17 has image forming units 20Y, 20M, 20C, 20K which form respective images using toners of yellow (Y), magenta (M), cyan (C), black (K), scanning heads 19Y, 19M, 19C, 19K provided corresponding to the image forming units, and an intermediate transfer belt 21, and so on.

The image forming units 20Y, 20M, 20C, 20K are arranged below the intermediate transfer belt 21. In the image forming device 17, the image forming units 20Y, 20M, 20C, 20K are arranged from an −X side toward an +X side. The scanning heads 19Y, 19M, 19C, 19K are arranged respectively below the image forming units 20Y, 20M, 20C, 20K.

Figure 2:
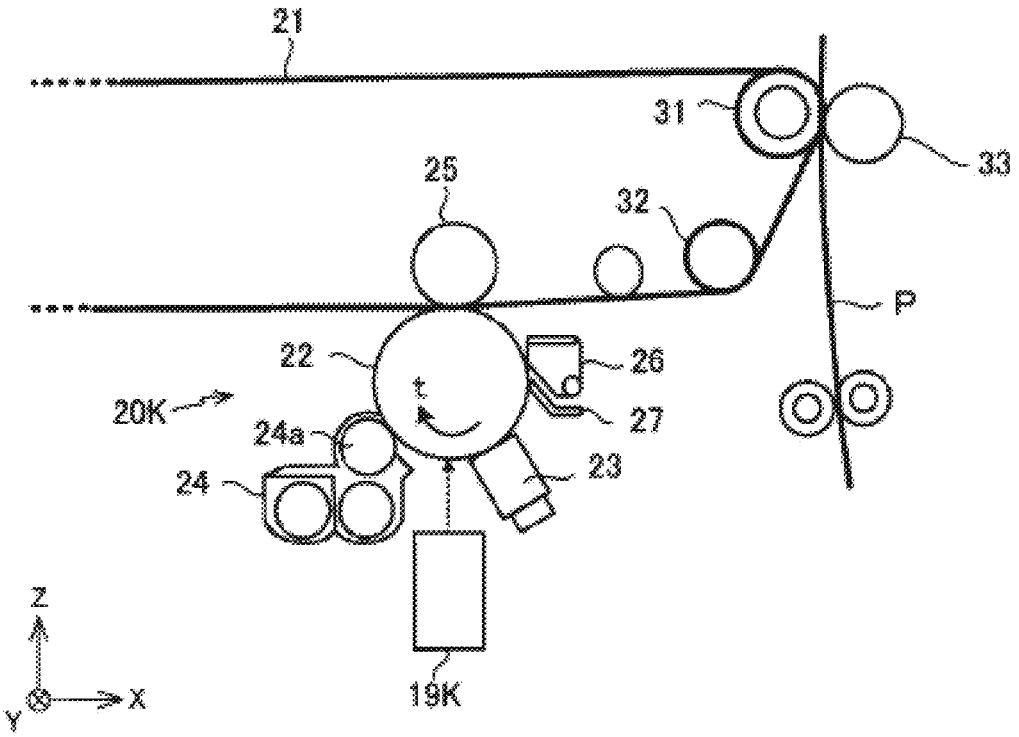
FIG. 2 is an enlarged diagram showing the image forming device of the image forming apparatus according to the embodiment.

FIG. 2 shows the image forming unit 20K by enlargement out of the image forming units 20Y, 20M, 20C, 20K. The image forming units 20Y, 20M, 20C, 20K have each the same configuration. Accordingly, the configuration of each of the image forming units will be described, taking the image forming unit 20K for example.

The image forming unit 20K has a photoreceptor drum 22 that is an image carrier. A charger 23, a developing device 24, a primary transfer roller 25, a cleaner 26 including a blade 27, and so on are arranged around the photoreceptor drum 22 along a direction shown by an arrow t. An exposure position of the photoreceptor drum 22 is irradiated with light from the scanning head 19K. By this means, the surface of the photoreceptor drum 22 is exposed. The surface of the rotating photoreceptor drum 22 is exposed, and thereby an electrostatic latent image is formed on the surface of the photoreceptor drum 22.

The charger 23 of the image forming unit 20K uniformly charges the surface of the photoreceptor drum 22 before the above-described exposure. The developing device 24 has a developing roller 24*a*. A developing bias is applied to the developing roller 24*a*. The developing device 24 supplies toner to the photoreceptor drum 22 by the developing roller 24*a* to perform development of the above-described electrostatic latent image. By this means, a toner image is formed on the surface of the photoreceptor drum 22. The cleaner 26 removes residual toner on the surface of the photoreceptor drum 22 using the blade 27, after the primary transfer described later.

As shown in FIG. 1, the intermediate transfer belt 21 is stretched by a drive roller 31 and three driven rollers 32. The drive roller 31 is rotated, and thereby the intermediate transfer belt 21 endlessly travels counterclockwise in FIG. 1. In addition, as shown in FIG. 1, the intermediate transfer belt 21 is in contact with the respective upper surfaces of the photoreceptor drums 22 of the image forming units 20Y, 20M, 20C, 20K. A primary transfer roller 25 is arranged at a position of the intermediate transfer belt 21 opposite to the photoreceptor drum 22. A primary transfer voltage is applied to the primary transfer roller 25. By this means, the toner image on the surface of the photoreceptor drum 22 is primarily transferred to the intermediate transfer belt 21.

A secondary transfer roller 33 is arranged opposite to the drive roller 31 to stretch the intermediate transfer belt 21. When a sheet P passes between the drive roller 31 and the secondary transfer roller 33, a secondary transfer voltage is applied to the secondary transfer roller 33. By this means, the toner image formed on the intermediate transfer belt 21 is secondarily transferred to the sheet P. A belt cleaner 34 is provided in the vicinity of the driven roller 32 of the intermediate transfer belt 21, as shown in FIG. 1. The residual toner on the surface of the intermediate transfer belt 21 is removed by the belt cleaner 34, after the above-described secondary transfer.

Sheet feeding rollers 35 are provided between the sheet feeding cassette 18 and the secondary transfer roller 33, as shown in FIG. 1. A sheet P which has been taken out from the sheet feeding cassette 18 by a pickup roller 18*a* arranged in the vicinity of the sheet feeding cassette 18 is conveyed between the intermediate transfer belt 21 and the secondary transfer roller 33 by the sheet feeding rollers 35.

A fixing device 50 is provided above the secondary transfer roller 33. In addition, a sheet discharge roller 37 is provided above the fixing device 50. The sheet P which has passed between the intermediate transfer belt 21 and the secondary transfer roller 33 is heated by the fixing device 50. By this means, the toner image is fixed to the sheet P. The sheet P which has passed through the fixing device 50 is discharged to a sheet discharge portion 38 by the sheet discharge roller 37.

Figure 3:
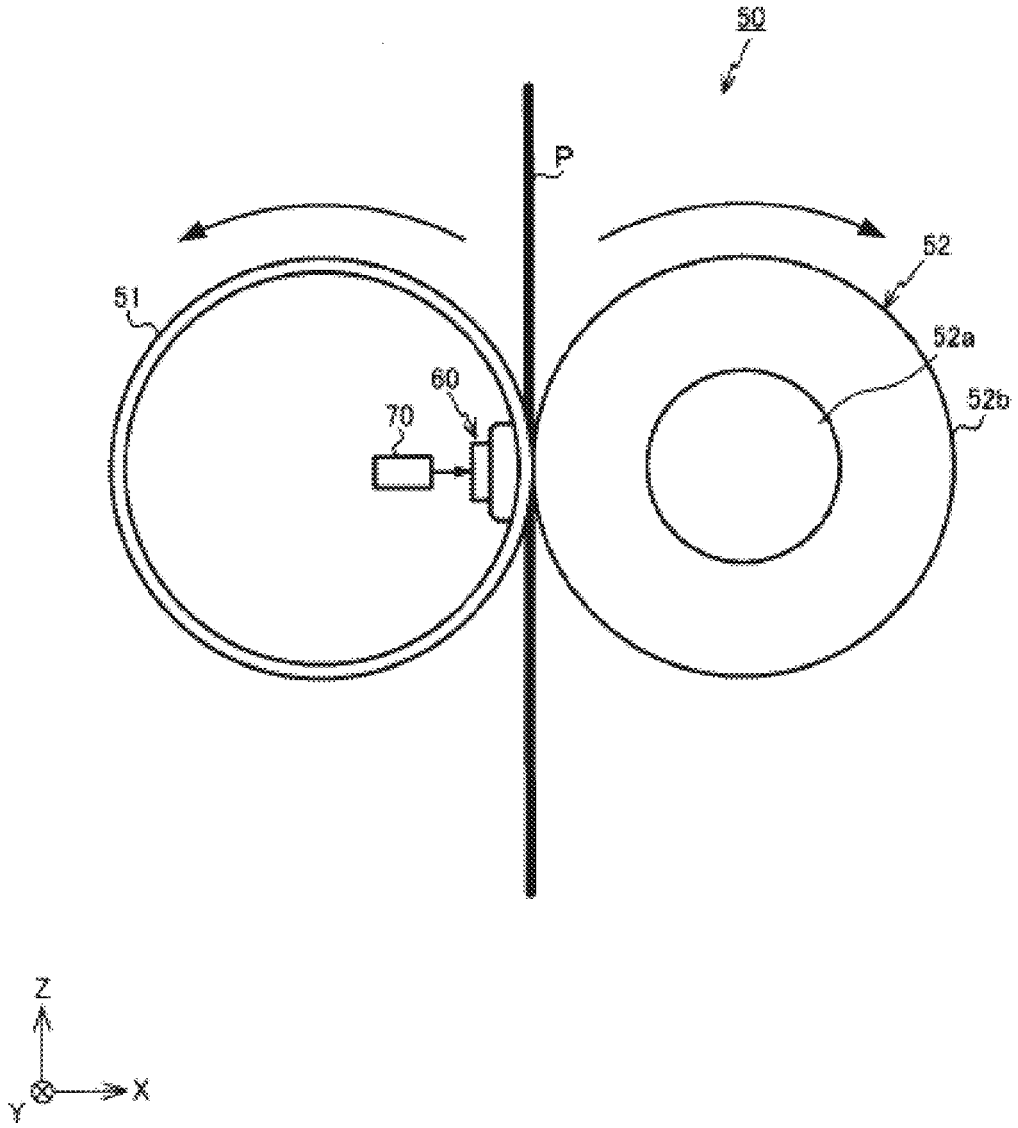
FIG. 3 is a diagram showing an example of the fixing device according to the embodiment.

FIG. 3 shows one example of the fixing device 50. The fixing device 50 has a fixing belt 51, a press roller 52, a heating device 60 to be arranged inside the fixing belt 51, and a temperature sensor 70.

The fixing belt 51 is a cylindrical member whose longitudinal direction is the Y-axis direction. A length of the fixing belt 51 is larger than a width of the sheet P (a size in the Y-axis direction). The fixing belt 51 is a member whose material is a polyimide sleeve, for example. A metal layer such as a Ni layer and a Cu layer is formed outside the fixing belt 51. The fixing belt 51 is supported rotatably around an axis parallel to the Y-axis.

The press roller 52 is a columnar member whose longitudinal direction is the Y-axis direction. The press roller 52 has a core material 52*a* made of metal such as aluminum, and a silicone rubber layer 52*b* laminated on the outer circumferential surface of the core material 52*a*. A surface of the silicone rubber layer 52*b* is coated with a PFA resin (perfluoroalkoxy fluororesin). The press roller 52 has an outer diameter of about 25 mm, and a length approximately equal to the length of the fixing belt 51. The press roller 52 is energized in a direction toward the fixing belt 51 (the −X direction) by an elastic member not shown. By this means, the press roller 52 is pressed to the heating device 60 via the fixing belt 51. By this means, the surface of the press roller 52 and the surface of the fixing belt 51 come in close contact with each other, and thereby a nip in which the sheet P passes is formed.

Figure 4:
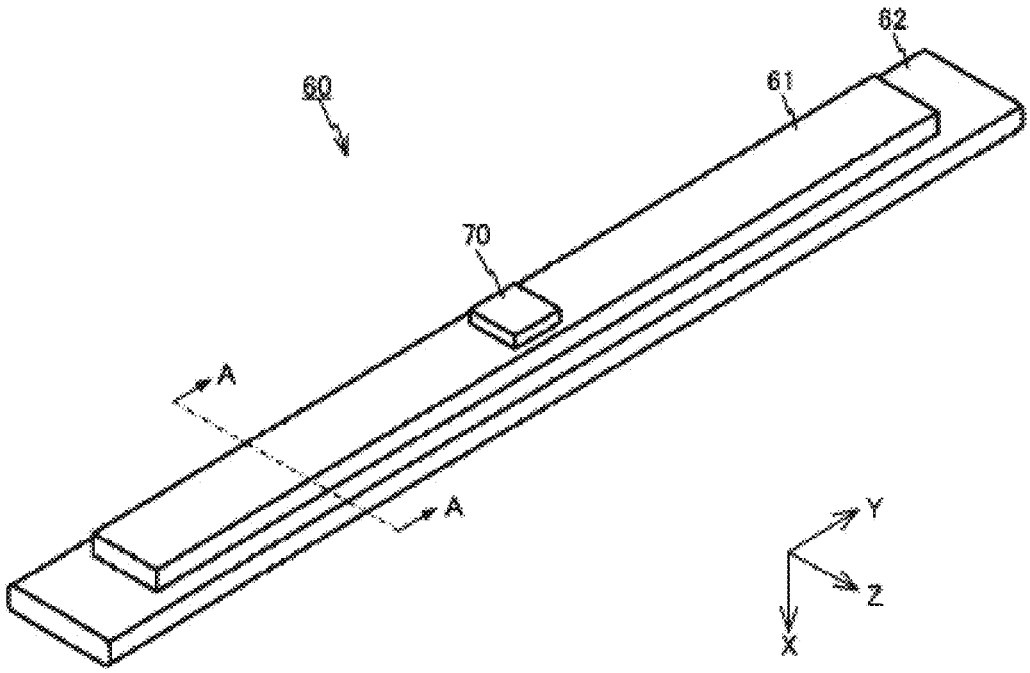
FIG. 4 is a perspective view of the heating device according to the embodiment.

FIG. 4 is a perspective view of the heating device 60. The heating device 60 has a heater 61 and a heat pipe 62.

Figure 5:
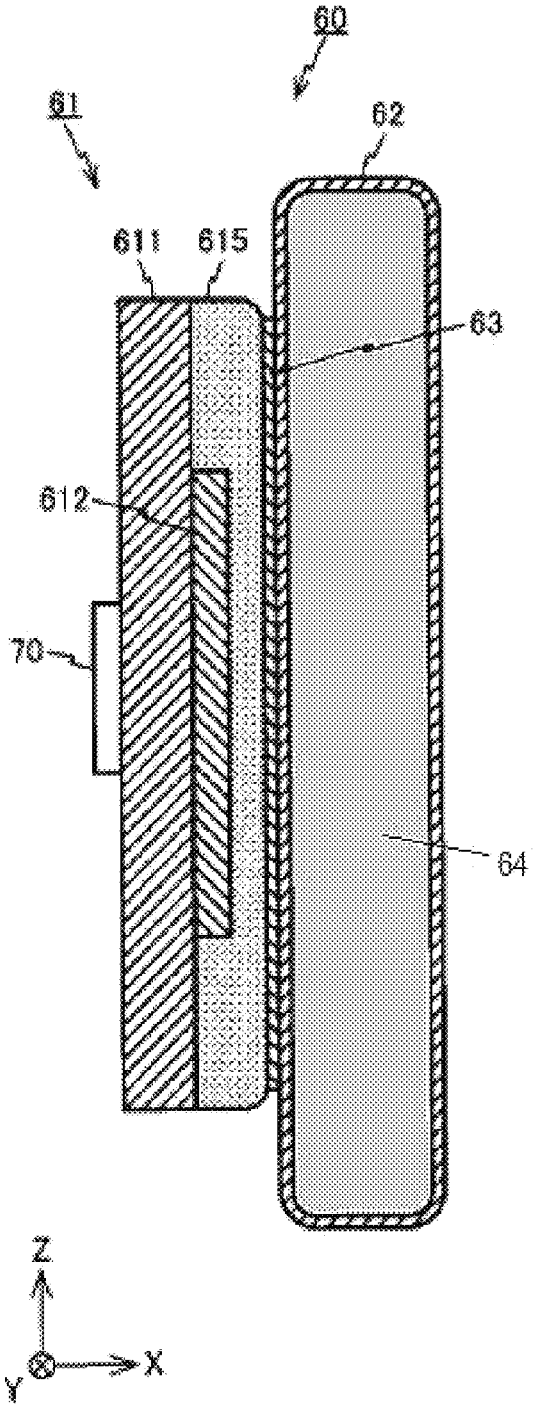
FIG. 5 is a sectional view showing the heating device according to the embodiment.

The heater 61 is a ceramic heater whose longitudinal direction is the Y-axis direction. FIG. 5 shows an AA section of the heating device 60 shown in FIG. 4. As shown in FIG. 5, the heater 61 has a substrate 611, a heating portion 612 to be formed on the substrate 611 and a glaze layer 615. The substrate 611 is a rectangular plate shaped member made of ceramic, for example.

Figure 6:
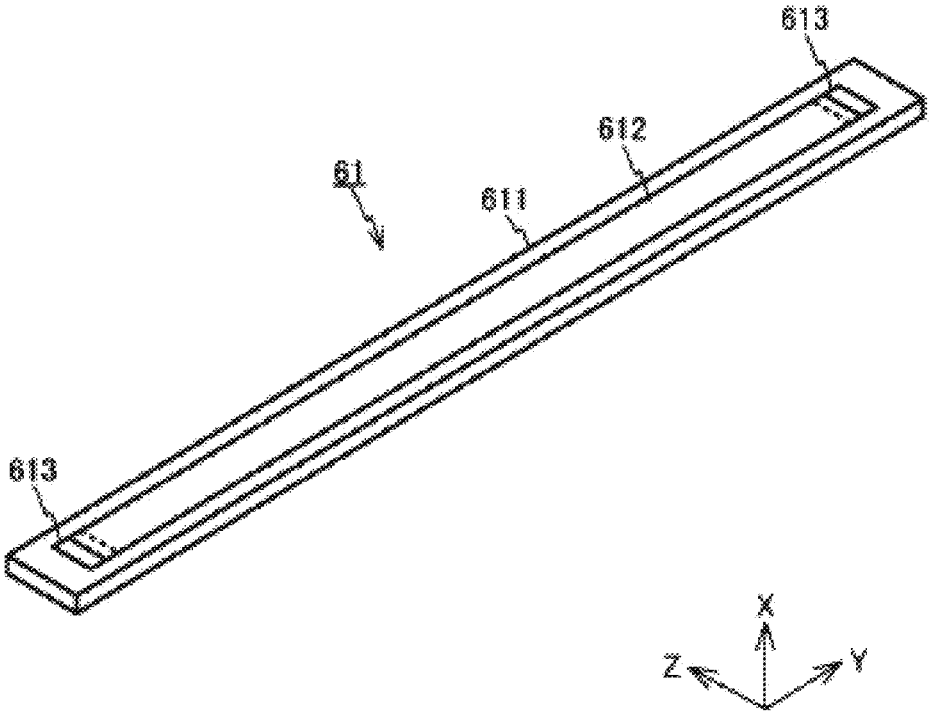
FIG. 6 is a perspective view of the heater according to the embodiment.

FIG. 6 is a perspective view of the heater 61. As shown in FIG. 6, the heating portion 612 whose longitudinal direction is the Y-axis direction is formed on an upper surface (a surface at the +X side) of the substrate 611. The heating portion 612 can be formed by performing screen printing of paste containing silver (Ag) and palladium (Pd), for example. A length (a size in the Y-axis direction) of the heating portion 612 is about 220 mm, and a width (a size in the Z-axis direction) thereof is about 5 mm. In addition, a thickness of the heating portion 612 is about 10 μm.

Both ends in the longitudinal direction of the heating portion 612 are respectively connected to electrodes 613. The electrode 613 is made of metal having a low resistivity such as copper. The electrode 613 is formed on the surface of the substrate 611 so that a part of the electrode 613 is located between the heating portion 612 and the substrate 611.

As can be found with reference to FIG. 5, the heating portion 612 and the electrodes 613 are coated with the glaze layer 615 to be formed on the surface at the +X side of the substrate 611. The glaze layer 615 is a protective layer having glass ($SiO_2$) as a main component, for example. A thickness of the glaze layer 615 is about 50 μm.

As shown in FIG. 4, the temperature sensor 70 is attached to a surface at the −X side of the heater 61. As the temperature sensor 70, a thermistor whose resistance value changes in response to a temperature, or the like is used, for example.

As shown in FIG. 4, the heat pipe 62 is a member whose longitudinal direction is the Y-axis direction. A length (a size in the Y-axis direction) of the heat pipe 62 is about 325 mm, and a width (a size in the Z-axis direction) thereof is about 8 mm. In addition, a thickness of the heat pipe 62 is about 2 mm. As shown in FIG. 5, the heat pipe 62 is a hollow member. The heat pipe 62 is made of stainless steel (SUS) with a thickness of 0.5 mm, for example, and the internal space is filled with water 64, for example.

As shown in FIG. 5, the glaze layer 615 of the heater 61 and the surface at the −X side of the heat pipe 62 are bonded via a heat conductive layer 63 having a high heat conductivity. The heat conductive layer 63 is a layer in which silicone-based adhesive having a high heat conductivity has been hardened, for example. A heat conductivity of the heat conductive layer 63 is preferably not more than 10 W/m·K. In addition, a thickness of the heat conductive layer 63 is preferably not more than 1 mm.

After the glaze layer 615 of the heater 61 and the heat pipe 62 have been bonded using silicone-based adhesive, the adhesive is hardened, and thereby the heat conductive layer 63 is formed between the glaze layer 615 and the heat pipe 62.

Figure 7:
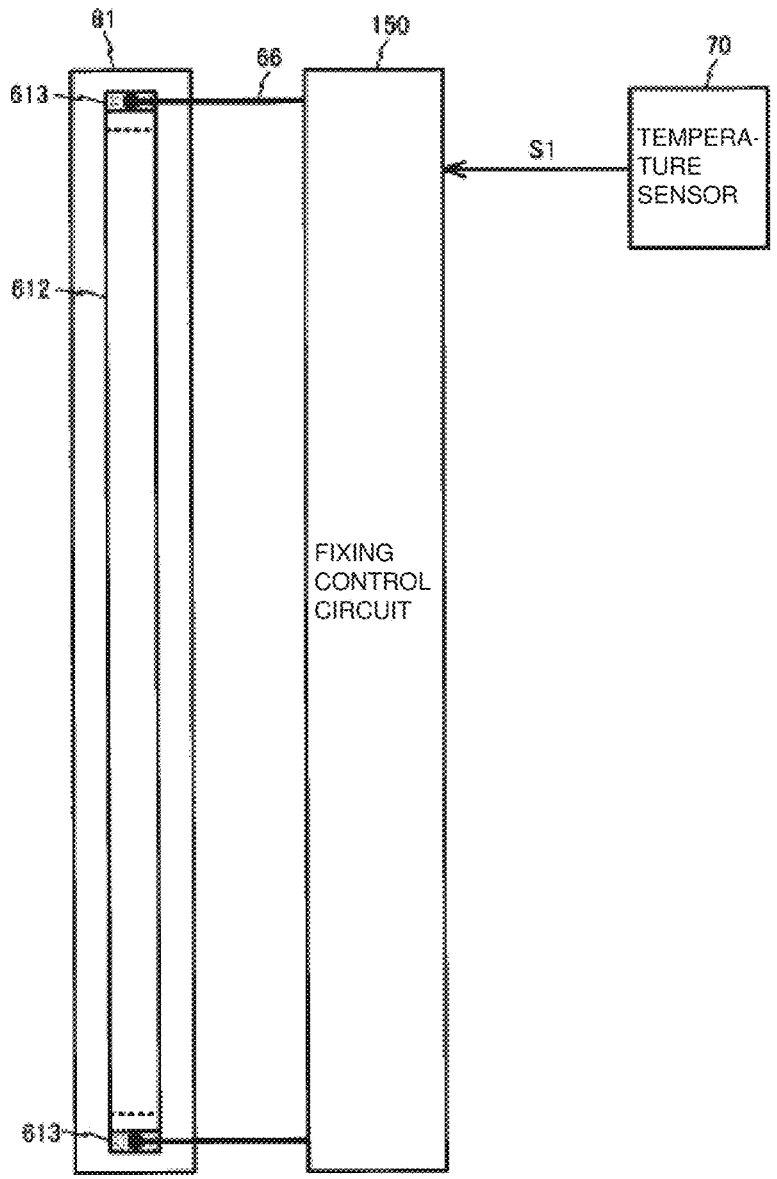
FIG. 7 is a wiring diagram of a fixing control circuit to be electrically connected to the heater in the embodiment.

In the heating device 60 configured as described above, the heater 61 is electrically connected to a fixing control circuit 150. FIG. 7 is a wiring diagram of the fixing control circuit 150 to be electrically connected to the heater 61. As shown in FIG. 7, the electrodes 613 are electrically connected to the fixing control circuit 150 by respective wirings 66.

The fixing control circuit 150 measures a temperature of the heater 61 via the temperature sensor 70. And, the fixing control circuit 150 applies a voltage between a pair of the electrodes 613, based on the measurement result of the temperature. By this means, the heating portion 612 of the heater 61 generates heat.

Figure 8:
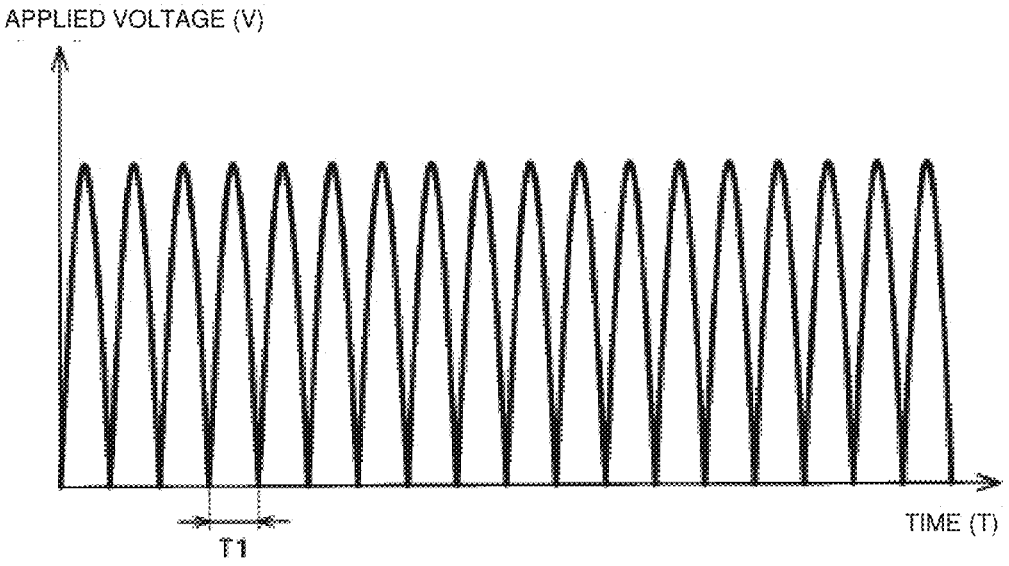
FIG. 8 is a diagram showing a basic waveform of a voltage to be applied to the heater in the embodiment.

FIG. 8 is a diagram showing a basic waveform of the voltage to be applied between the electrodes 613. The voltage shown in FIG. 8 is a voltage to be generated by performing full-wave rectification of a voltage of a commercial power supply of 50 Hz, for example. For the reason, a cycle T1 of the applied voltage is 1/100 sec. The fixing control circuit 150 sets the voltage shown by the basic waveform of FIG. 8 to a reference voltage, and changes a duty ratio of the relevant reference voltage to generate and output a voltage to be applied to the heater 61.

Figure 9:
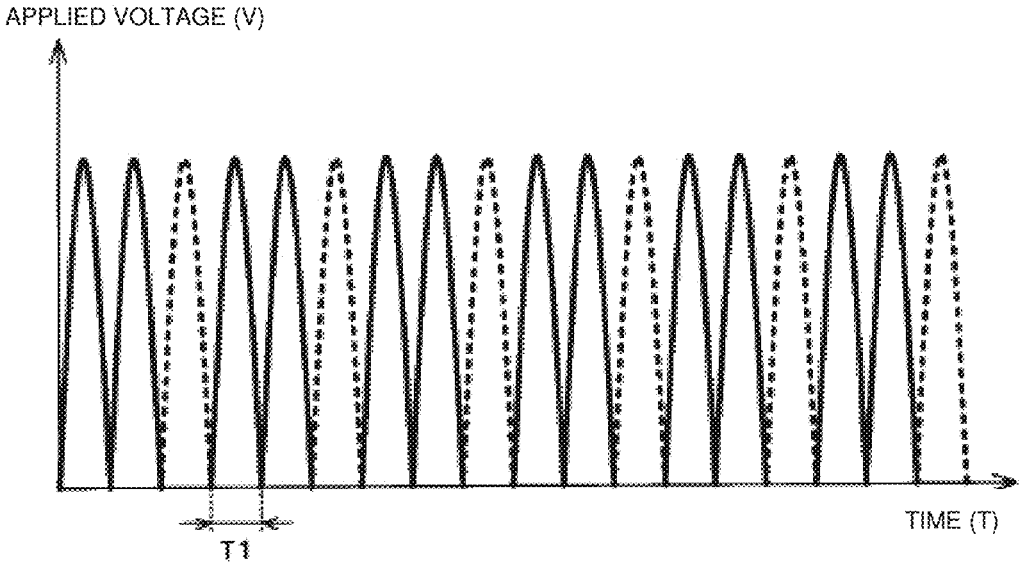
FIG. 9 is a diagram showing a waveform of a voltage to be applied to the heater in the embodiment.

Specifically, the fixing control circuit 150 obtains a ratio R (=Wt/Wm) of a width Wm of a sheet P having a largest size which is to be used in the image forming apparatus 10, and a width Wt of a sheet P to become an object to be heated. And the fixing control circuit 150 calculates a target duty ratio DRt by multiplying a duty ratio DR of the reference voltage by the calculated ratio R. For example, when the duty ratio DR of the reference voltage is 1 as shown in FIG. 8, and the ratio R is 2/3, the target duty ratio DRt becomes 2/3. In this case, the fixing control circuit 150 generates and outputs an applied voltage which is ON for a period of 2·T1 sec. and is OFF for a period of 1·T1 sec. in every 3·T1 sec., as shown in FIG. 9. By this means, a power in accordance with a width of a sheet P is supplied to the heater 61.

Figure 10:
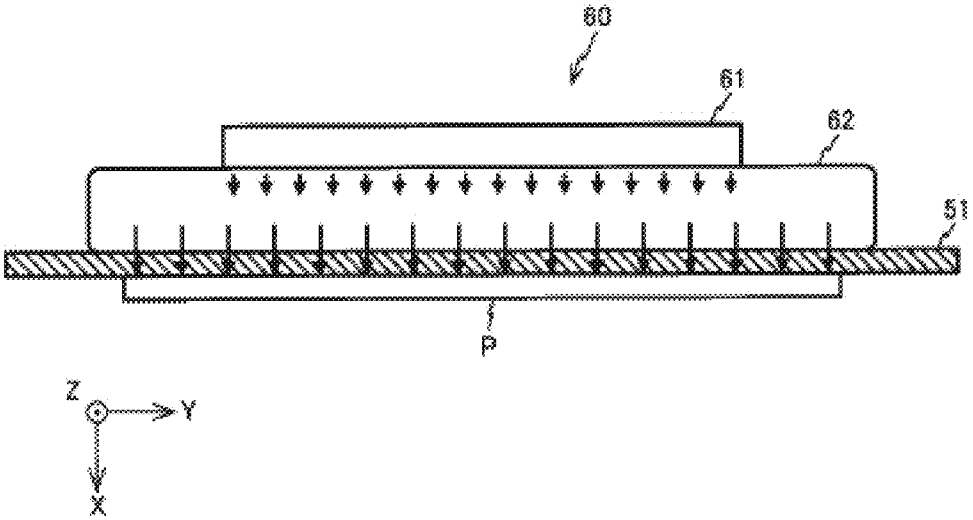
FIG. 10 is a diagram schematically showing an aspect in which heat from the heater is transmitted to the sheet in the embodiment.
Figure 11:
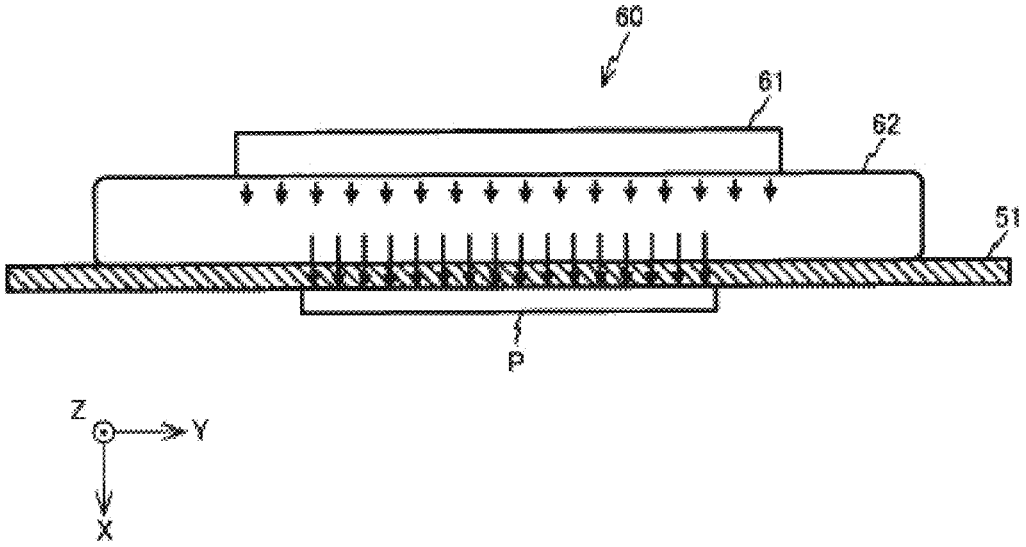
FIG. 11 is a diagram schematically showing an aspect in which heat from the heater is transmitted to the sheet in the embodiment.

When the power is supplied to the heater 61, the heating portion 612 of the heater 61 generates heat. FIG. 10 and FIG. 11 are diagrams each schematically showing an aspect in which the heat from the heater 61 is transmitted to the sheet P via the heat pipe 62 and the fixing belt 51. In the heating device 60, a surface at the +X side of the heat pipe 62 is pressed to the sheet P via the fixing belt 51. In the case of heating a sheet P having a width larger than a width (a length in the Y-axis direction) of the heater 61, as shown in FIG. 10, when being transmitted to the sheet P via the heat pipe 62, the heat from the heater 61 is approximately equally dispersed to the sheet P having a low temperature, as shown by arrows in the drawing. For the reason, the sheet P is heated without temperature unevenness.

In the case of heating a sheet P having a width smaller than the width (the length in the Y-axis direction) of the heater 61, as shown in FIG. 11, when being transmitted to the sheet P via the heat pipe 62, the heat from the heater 61 approximately equally converges to the sheet P having a low temperature, as shown by arrows in the drawing. For the reason, the sheet P is heated without temperature unevenness.

In the fixing device 50 configured as described above, the press roller 52 is rotated, and thereby a sheet P passes between the nip of the press roller 52 and the fixing belt 51 which are being rotated respectively in the directions shown by arrows in FIG. 3. By this means, the sheet P is heated, and thereby the toner image formed on the sheet P is fixed to the sheet P.

Figure 12:
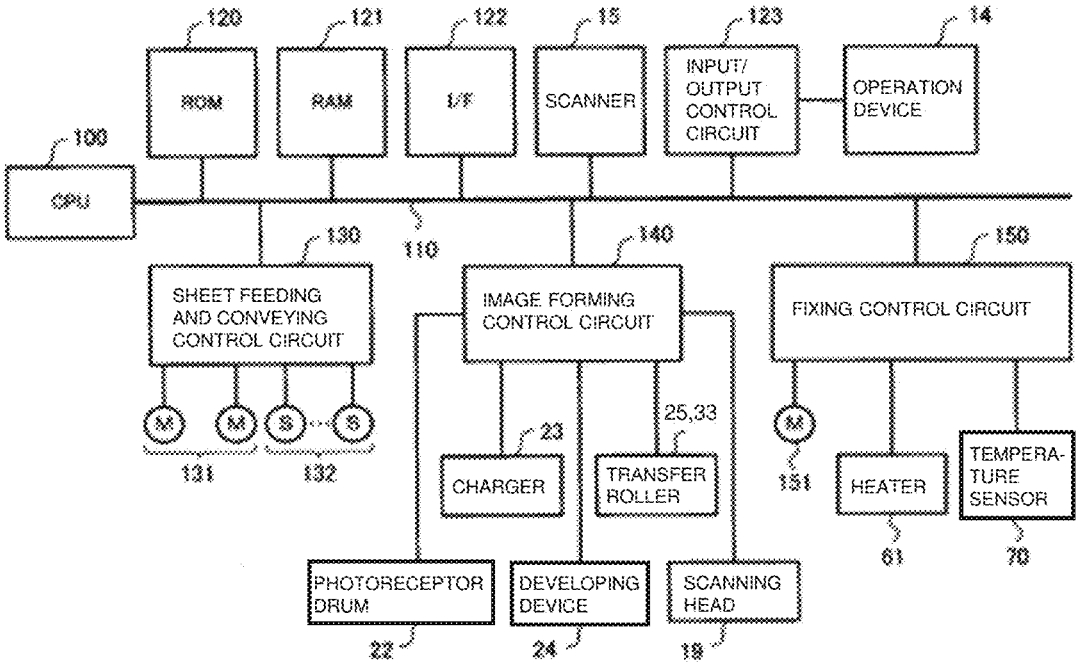
FIG. 12 is a block diagram of a control system to configure the image forming apparatus according to the embodiment.

FIG. 12 is a block diagram of a control system to configure the image forming apparatus 10. The image forming apparatus 10 has, as its control system, a CPU 100 to control the whole of the image forming apparatus, a bus line 110, a read only memory (ROM) 120, a random access memory (RAM) 121, an interface 122, the scanner 15, an input/output control circuit 123, a sheet feeding and conveying control circuit 130, an image forming control circuit 140, and the fixing control circuit 150, for example. The CPU 100 and the respective circuits are connected via the bus line 110.

The ROM 120 stores a control program to prescribe a basic operation of image forming processing and control data, and so on. The control program to control the fixing device 50 includes a determination logic to determine a size of a sheet on which a toner image is formed, and a heating control logic to calculate a power in accordance with the size of the sheet, and to supply the power to the fixing device 50 in accordance with the calculation result.

The RAM 121 functions as a working memory acting as a work area of the CPU 100.

The CPU 100 executes the program stored in the ROM 120. By this means, processings to form an image are sequentially executed.

The interface 122 performs communication with a device such as a terminal which a user uses. The input/output control circuit 123 controls the operation device 14. The input/output control circuit 123 makes a display of the operation device 14 display necessary information. The input/output control circuit 123 accepts an input of the information from the operation device 14. A user of the image forming apparatus 10 operates the operation device 14, and thereby can designate a sheet size, the number of copies of a document, and so on, for example.

The sheet feeding and conveying control circuit 130 controls a group 131 of motors which drive the pickup roller 18*a*, the sheet feeding rollers 35, the sheet discharge roller 37 on the conveying path, and so on. The sheet feeding and conveying control circuit 130 controls the group 131 of motors in accordance with the detection result of various sensors 132 which are provided in the vicinity of the sheet feeding cassettes 18 or on the conveying path, based on control signals from the CPU 100.

The image forming control circuit 140 controls respectively the photoreceptor drums 22, the chargers 23, the scanning heads 19 (19Y, 19M, 19C, 19K), the developing devices 24, the primary transfer roller 25 and the secondary transfer roller 33, based on control signals from the CPU 100.

The fixing control circuit 150 controls a drive motor 151 to rotate the press roller 52 of the fixing device 50, based on a control signal from the CPU 100. In addition, the fixing control circuit 150 drives the heater 61, based on an output from the temperature sensor 70 and a size of a sheet P to be notified from the CPU 100, and so on.

Next, a print processing of the image forming apparatus 10 configured as described above will be described. The print processing in the image forming apparatus 10 is performed, when image data received via the interface 122 is printed, or when image data generated by the scanner 15 is printed.

In the print processing, the pickup roller 18*a* shown in FIG. 1 draws out a sheet P from the sheet feeding cassette 18. The sheet feeding roller 35 conveys the sheet P between the intermediate transfer belt 21 and the secondary transfer roller 33.

In parallel with the above-described sheet feeding and conveying operation, the image forming units 20Y, 20M, 20C, 20K form toner images on the photoreceptor drums 22, respectively. The toner images formed on the respective photoreceptor drums 22 of the image forming units 20Y, 20M, 20C, 20K are sequentially transferred to the intermediate transfer belt 21. By this means, a toner image composed of a toner of yellow (Y), a toner of magenta (M), a toner of cyan (C), a toner of black (K) is formed on the intermediate transfer belt 21.

When the sheet P passes between the intermediate transfer belt 21 and the secondary transfer roller 33, the toner image formed on the intermediate transfer belt 21 is transferred to the sheet P. By this means, the toner image composed of the toners of yellow (Y), magenta (M), cyan (C), black (K) is formed on the sheet P.

The sheet P formed with the toner image passes through the fixing device 50. At this time, the fixing control circuit 150 supplies a power in accordance with a size of the sheet P to the heater 61. By this means, the heater 61 generates heat, and the heat from the heater 61 is transmitted to the sheet P via the heat pipe 62. The heat is transmitted to the sheet P, and thereby the sheet P is heated and the toner image transferred to the sheet P is fixed to the sheet P. An image is formed on the sheet P in this manner. The sheet discharge roller 37 discharges the sheet P formed with the image to the sheet discharge portion 38.

As described above, the heating device 60 which the fixing device 50 according to the present embodiment has transmits the heat from the heater 61 to the sheet P via the heat pipe 62, as shown in FIG. 10 and FIG. 11. For the reason, even when a width of the sheet P and a width of the heater 61 are different, it is possible to heat the sheet P uniformly.

For the reason, according to the present embodiment, compared with a conventional heating system which divides a heating portion of the heater 61 in accordance with a size of a sheet to be used in the image forming apparatus 10, and selectively heats in accordance with the size of the sheet, it is possible to make the configuration of the heater 61 simple. In addition, even when temperature unevenness is generated in the heating portion 612 of the heater 61, it is possible to equally transmit heat to the sheet P by the heat pipe 62. For the reason, it is possible to simply perform temperature control of the heater 61.

In the fixing device 50 according to the present embodiment, even when a width of a sheet P is narrower than the width of the heating portion 612 of the heater 61, heat is transmitted to the sheet P having a low temperature while being approximately equally converged to the sheet P by the heat pipe 62, as shown by the arrows in FIG. 11. For the reason, compared with a case of heating a sheet P without through the heat pipe 62, power loss is suppressed, and thereby it is possible to reduce a power necessary for heating the sheet P.

In the heating device 60 of the fixing device 50 according to the present embodiment, the heater 61 and the heat pipe 62 are connected via the heat conductive layer 63, as shown in FIG. 5. For the reason, it is possible to efficiently transmit the heat generated in the heater 61 to the heat pipe 62. Accordingly, it is possible to suppress loss of a power necessary for heating the sheet P. As a result, it is possible to reduce power consumption necessary for heating the sheet P.

And a heat conductivity of the heat conductive layer 63 is preferably not less than 10 W/m·K. Table 1 below shows the relationship between a heat conductivity of the heat conductive layer 63 and a rise time of the fixing device 50. The results shown in Table 1 are obtained by measuring the time until the surface temperature of the fixing belt 51 reaches 150° C. by inputting 600 W of electric power to the heater in the fixing device 50 at room temperature of about 25° C.

TABLE 1

| heat conductivity | rise time |
|---|---|
| 25 W/m · K | 4.8 sec. |
| 10 W/m · K | 5.0 sec. |
| 5 W/m · K | 8.8 sec. |

As shown in Table 1, when a heat conductivity of the heat conductive layer 63 is 10 W/m·K, a rise time of the fixing device 50 was 5 sec. In addition, when a heat conductivity of the heat conductive layer 63 is 25 W/m·K, a rise time of the fixing device 50 was 4.8 sec. On the other hand, when a heat conductivity of the heat conductive layer 63 is 5

W/m·K, a rise time of the fixing device 50 was 8.8 sec. Considering that a rise time of the fixing device 50 is generally about 5 sec., the heat conductivity of the heat conductive layer 63 is preferably not less than 10 W/m·K.

In addition, a rise time of the fixing device 50 was measured in the same manner, in a state in which the heater 61 and the heat pipe 62 are made in contact with each other without using the heat conductive layer 63, a rise time of the fixing device 50 was about 10 sec. For the reason, even when the heat conductivity of the heat conductive layer 63 is lower than 10 W/m·K, it is said to be preferable that the heater 61 and the heat pipe 62 are connected via the heat conductive layer 63.

The fixing device 50 according to the present embodiment calculates the target duty ratio DRt by multiplying the duty ratio DR of the reference voltage by the ratio R of the width Wm of the sheet P having the largest size which is to be used in the image forming apparatus 10, and the width Wt of the sheet P to become the object to be heated. And the fixing device 50 applies the voltage corresponding to the target duty ratio DRt to the heater 61. For the reason, assuming that a power Pm when the reference voltage for making the power maximum is applied to the heater 61 is 1200 W, a power obtained by multiplying the power Pm by the target duty ratio DRt becomes a power to be supplied to the heater 61. For example, when the target duty ratio DRt is 0.5, a power of 600 W is supplied to the heater 61.

In addition, the fixing device 50 performs full-wave rectification of a voltage of 50 Hz. The fixing device 50 sets a voltage obtained by performing full-wave rectification to the reference voltage. For the reason, it is possible to generate a power to be inputted to the heater 61 with a resolution of 1/100. Specifically, it is possible to control a power to be supplied to the heater 61 from 0 W to Pm (=1200 W) by 12 W. Accordingly, the fixing device 50 can perform control such that an input power to the heater 61 is set to 804 W when a width of a sheet P is equal to a lateral width 297 mm of a sheet of A4 size. In addition, the fixing device 50 can perform control such that an input power to the heater 61 is set to 696 W when a width of a sheet P is equal to a lateral width 257 mm of a sheet of B4 size. In addition, the fixing device 50 can perform control such that an input power to the heater 61 is set to 564 W when a width of a sheet P is equal to a longitudinal width 210 mm of a sheet of A4 size.

As described above, in the present embodiment, it becomes possible to perform a simple temperature control using only the size Wt of the sheet P as a parameter with high resolution. In addition, almost all the heat from the heater 61 is transmitted to the sheet P via the heat pipe 62. For the reason, power loss at the time of heating the sheet P is reduced.

The image forming apparatus 10 according to the present embodiment has the above-described fixing device 50. For the reason, it becomes possible to precisely form an image with small power consumption.

The embodiment has been described above, but the present invention is not limited to the above-described embodiment. For example, in the above-described embodiment, the control program and the control data of the fixing device 50 are stored in the storage device of the image forming apparatus. And the CPU 100 of the image forming apparatus executes the control program. However, without being limited to this, the above-described fixing device 50 may separately have an arithmetic processing unit and a storage device which are exclusive for the fixing device 50, in place of the storage device and the CPU 100 of the image forming apparatus.

In the above-described embodiment, the heat pipe 62 uses stainless steel as its material. Without being limited to this, the heat pipe 62 may use metal such as copper as its material.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heating device to be used in a fixing device to fix a toner image to a medium, the heating device comprising:

a heater arranged inside a cylindrical belt to be heated and including a heating portion on a substrate and a protective layer that covers the heating portion and the substrate;

a heat pipe having a continuous outer peripheral surface including a first outer surface that contacts an inner surface of the cylindrical belt and a second outer surface opposite to the first outer surface, wherein water is filled inside the continuous outer peripheral surface; and a heat conductive layer between the heater and the heat pipe, wherein one surface of the heat conductive layer contacts the protective layer, and the other surface of the heat conductive layer contacts the second outer surface of the heat pipe.

2. The heating device according to claim 1, wherein a heat conductivity of the heat conductive layer is not less than 10 W/m ·K.

3. The heating device according to claim 1, wherein a thickness of the heat conductive layer is not more than 1 mm.

4. The heating device according to claim 1, further comprising:

a control circuit configured to control power to be supplied to the heater according to a width of the medium to be heated.

5. The heating device according to claim 4, wherein the control circuit is configured to control the power according to a ratio of a maximum width of the medium that can be heated by the heating device, to the width of the medium to be heated.

6. The heating device according to claim 1, wherein the heater has a pair of electrodes connected to both ends of the heating portion in a longitudinal direction thereof, and a voltage is applied to the pair of electrodes, and thereby power is supplied to the heater according to a length in the longitudinal direction of the medium to be heated.

7. The heating device according to claim 6, wherein the power is supplied according to a ratio of a maximum length in the longitudinal direction of the medium that can be heated by the heating device, to the length of the medium to be heated.

8. A fixing device to fix a toner image to a medium, the fixing device comprising:

a cylindrical belt that is rotatably supported and in contact with the medium; and a heating device configured to heat the medium via the cylindrical belt and including a heater arranged inside the cylindrical belt to be heated and including a heating portion on a substrate and a protective layer that covers the heating portion and the substrate, a heat pipe having a continuous outer peripheral surface including a first outer surface that contacts an inner surface of the cylindrical belt and a second outer surface opposite to the first outer surface wherein water is filled inside the continuous outer peripheral surface, and a heat conductive layer between the heater and the heat pipe, wherein one surface of the heat conductive layer contacts the protective layer, and the other surface of the heat conductive layer contacts the second outer surface of the heat pipe.

9. The fixing device according to claim 8, wherein the heating device has a fixing control circuit configured to control power to be supplied to the heater according to a width of the medium to be heated.

10. The fixing device according to claim 9, wherein the fixing control circuit is configured to control the power according to a ratio of a maximum width of the medium that can be heated by the heating device, to the width of the medium to be heated.

11. The fixing device according to claim 8, wherein the heater has a pair of electrodes connected to both ends of the heating portion in a longitudinal direction thereof, and a voltage is applied to the pair of electrodes, and thereby power is supplied to the heater according to a length in the longitudinal direction of the medium to be heated.

12. The fixing device according to claim 11, wherein the power is supplied according to a ratio of a maximum length in the longitudinal direction of the medium that can be heated by the heating device, to the length of the medium to be heated.

13. The fixing device according to claim 8, further comprising:

a press roller that is in close contact with the cylindrical belt to form a nip in which the medium passes, wherein the heating device is arranged inside the cylindrical belt, and is opposite to the medium at a position where the nip is to be formed.

14. An image forming apparatus comprising:

a toner image forming device configured to form a toner image on a medium; and a fixing device configured to fix the toner image to the medium and including a cylindrical belt that is rotatably supported and in contact with the medium, and a heating device configured to heat the medium via the cylindrical belt and including a heater arranged inside the cylindrical belt to be heated and including a heating portion on a substrate and a protective layer that covers the heating portion and the substrate, a heat pipe having a continuous outer peripheral surface including a first outer surface that contacts an inner surface of the cylindrical belt and a second outer surface opposite to the first outer surface wherein water is filled inside the continuous outer peripheral surface, and a heat conductive layer between the heater and the heat pipe, wherein one surface of the heat conductive layer contacts the protective layer, and the other surface of the heat conductive layer contacts the second outer surface of the heat pipe.

15. The image forming apparatus according to claim 14, wherein:

the heating device has a fixing control circuit configured to control power to be supplied to the heater according to a width of the medium to be heated.

16. The image forming apparatus according to claim 15, wherein the fixing control circuit is configured to control the power according to a ratio of a maximum width of the medium that can be heated by the heating device.

17. The image forming apparatus according to claim 14, wherein the heater has a pair of electrodes connected to both ends of the heating portion in a longitudinal direction thereof, and a voltage is applied to the pair of electrodes, and thereby power is supplied to the heater according to a length in the longitudinal direction of the medium to be heated.

18. The image forming apparatus according to claim 17, wherein the power is supplied according to a ratio of a maximum length in the longitudinal direction of the medium that can be heated by the heating device, to the length of the medium to be heated.

19. The image forming apparatus according to claim 14, further comprising:

a press roller that is in close contact with the cylindrical belt to form a nip in which the medium passes, wherein the heating device is arranged inside the cylindrical belt, and is opposite to the medium at a position where the nip is to be formed.

* * * * *